US005638918A

United States Patent [19]

Hebda et al.

[11] Patent Number: 5,638,918

[45] Date of Patent: Jun. 17, 1997

[54] LADDER CONVERSION KIT

[76] Inventors: Dorothy E. Hebda; James R. Hebda, both of 911 Stephen Dr., Clarksville, Tenn. 37043

[21] Appl. No.: 503,641

[22] Filed: Jul. 18, 1995

[51] Int. Cl.[6] ..... E06C 1/20

[52] U.S. Cl. ..... 182/151; 182/22; 182/25; 182/129

[58] Field of Search ..... 182/21, 151, 115, 182/22, 129, 25

[56] References Cited

U.S. PATENT DOCUMENTS

| | | | |
|---|---|---|---|
| 91,039 | 6/1869 | Phillips | 182/25 |
| 1,028,691 | 6/1912 | Duncan | 182/25 |
| 1,462,707 | 7/1923 | Lawlor | 182/181 |
| 4,256,200 | 3/1981 | Loix . | |
| 4,284,171 | 8/1981 | Owen . | |
| 4,448,282 | 5/1984 | Giezendanner . | |
| 4,469,193 | 9/1984 | Rumsey, Jr. . | |
| 4,947,960 | 8/1990 | Krause . | |
| 5,158,151 | 10/1992 | Chang . | |
| 5,265,697 | 11/1993 | Quick | 182/151 X |
| 5,353,892 | 10/1994 | Lu . | |

FOREIGN PATENT DOCUMENTS

| | | |
|---|---|---|
| 2 435 596 | 4/1980 | France . |
| 995495 | 6/1965 | United Kingdom . |

*Primary Examiner*—Alvin C. Chin-Shue

[57] ABSTRACT

A ladder conversion kit for converting an extension ladder into a stepladder. The kit includes one or more pairs of support braces for holding the two ladder elements together to form the stepladder. In a first embodiment, there is a top pedestal unit with a supporting surface and four sleeves with clamps that hold the pedestal onto the side rails of the ladder elements. In a second embodiment, the pedestal has four slots in the supporting surface, through which the upper ends of the side rails fit, and bungee straps are attached to the supporting surface and hook onto rungs of the ladder elements. In a third embodiment, there is no pedestal, and the ladder elements are held together solely by the support braces. The support braces may clamp onto the side rails or rungs of the ladder elements, or, if the rungs are hollow, they may be attached to rods inserted through the rungs. If there is more than one pair of support braces, they may be of different lengths, so as to attach to and hold the ladder elements at different locations. The support braces are adjustable in length. For each embodiment, a paint tray and storage container for components are optionally included with the kit.

7 Claims, 8 Drawing Sheets

LADDER CONVERSION KIT

BACKGROUND OF THE INVENTION

1. Field of the Invention

The present invention relates to ladder constructions, and, more particularly, to a kit for converting a conventional extension ladder into a stepladder.

2. Description of the Prior Art

There have been previous inventions for convertible ladders, but the prior art does not teach a kit for converting a ladder in the manner disclosed in the instant application.

U.S. Pat. No. 4,256,200, issued on Mar. 17, 1981, to Gilbert Loix, discloses a stepladder which can be transformed into an extension ladder. The instant invention is distinguishable in that it is a kit for converting a ladder, not a ladder itself, and that it uses support braces for the stepladder mode that connect opposed side rails or rungs on the same level but opposite sides of the ladder.

U.S. Pat. No. 4,284,171, issued on Aug. 18, 1981, to Graham Owen, discloses a convertible ladder that can be set up as an extension ladder, a stepladder or a trestle. The instant invention is distinguishable in that it is a kit for converting a ladder, not a ladder itself, it does not have a trestle mode or a plank member for a trestle, and its support braces are connected to side rails of the ladder by encircling braces or with rods inserted through hollow rungs.

U.S. Pat. No. 4,448,282, issued on May 15, 1984, to Rnedi Giezendanner, discloses a multipurpose ladder construction which can be configured as a stepladder, an extension ladder, or a wheeled hand truck. The instant invention is distinguishable in that it is a kit for converting a conventional extension ladder, not a ladder itself, it does not have wheels, and when it has been installed to convert an extension ladder into a stepladder, the opposite sides of the ladder are held together by support braces between the side rails or rungs.

U.S. Pat. No. 4,469,193, issued on Sep. 4, 1984, to Joseph F. Rumsey, Jr., discloses a utility ladder that can be used either as an extension ladder, stepladder or stool. The instant invention is distinguishable in that it is a kit for converting a ladder, not a ladder itself, and when it has been installed to convert an extension ladder into a stepladder, the opposite sides of the ladder are held together by a novel support brace arrangement.

U.S. Pat. No. 4,947,960, issued on Aug. 14, 1990, to Guenther Krause, discloses a connecting element for connecting upper and lower parts of an extension ladder. It may be distinguished from the instant invention, in that the support brace of the latter encloses the entire circumference of a side rail or rung, or else connects to a rod going through a hollow rung.

U.S. Pat. No. 5,158,151, issued on Oct. 27, 1992, to Wan-Li Chang, discloses a bidirectionally foldable stepladder, which does not convert to an extension ladder.

U.S. Pat. No. 5,353,892, issued on Oct. 11, 1994, to Feng-Hui Lu, discloses a ladder joint for a folding collapsible ladder, in which opposite sides of the ladder are not connected by support braces.

British Patent No. 995,495, published on Jun. 16, 1965, discloses a ladder convertible from step to extending. The instant invention is distinguishable in that it is a kit for converting a ladder, not a ladder itself, and when it has been installed to convert an extension ladder into a stepladder, the opposite sides of the ladder are held together by a novel support brace assembly.

French Patent No. 2 435 596, published on Apr. 4, 1980, discloses a ladder convertible from step to extending, in which the connection between rungs on opposite sides in the stepladder mode is flexible, rather than rigid as in the instant invention.

None of the above inventions and patents, taken either singly or in combination, is seen to describe the instant invention as claimed.

SUMMARY OF THE INVENTION

Accordingly, it is a principal object of the invention to provide a kit for converting a conventional extension ladder into a stepladder, quickly and conveniently.

It is another object of the invention to provide a ladder conversion kit construction by which the converted stepladder can be conveniently returned to an extension ladder configuration.

It is a further object of the invention to provide means for securely holding the opposite sides of a convertible stepladder together.

Still another object of the invention is to provide a kit for converting a ladder, which may be purchased separately from the ladder to be converted, and that will save the user the expense of purchasing both an extension ladder and a stepladder.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a kit for converting an extension ladder having two separable, slidably interfitted ladder sections, into a step ladder. There are three preferred embodiments of the invention, based on the way the ladder elements are attached at the top, each of which has three variations, based on the way the ladder elements are joined by support braces.

Figure 1:
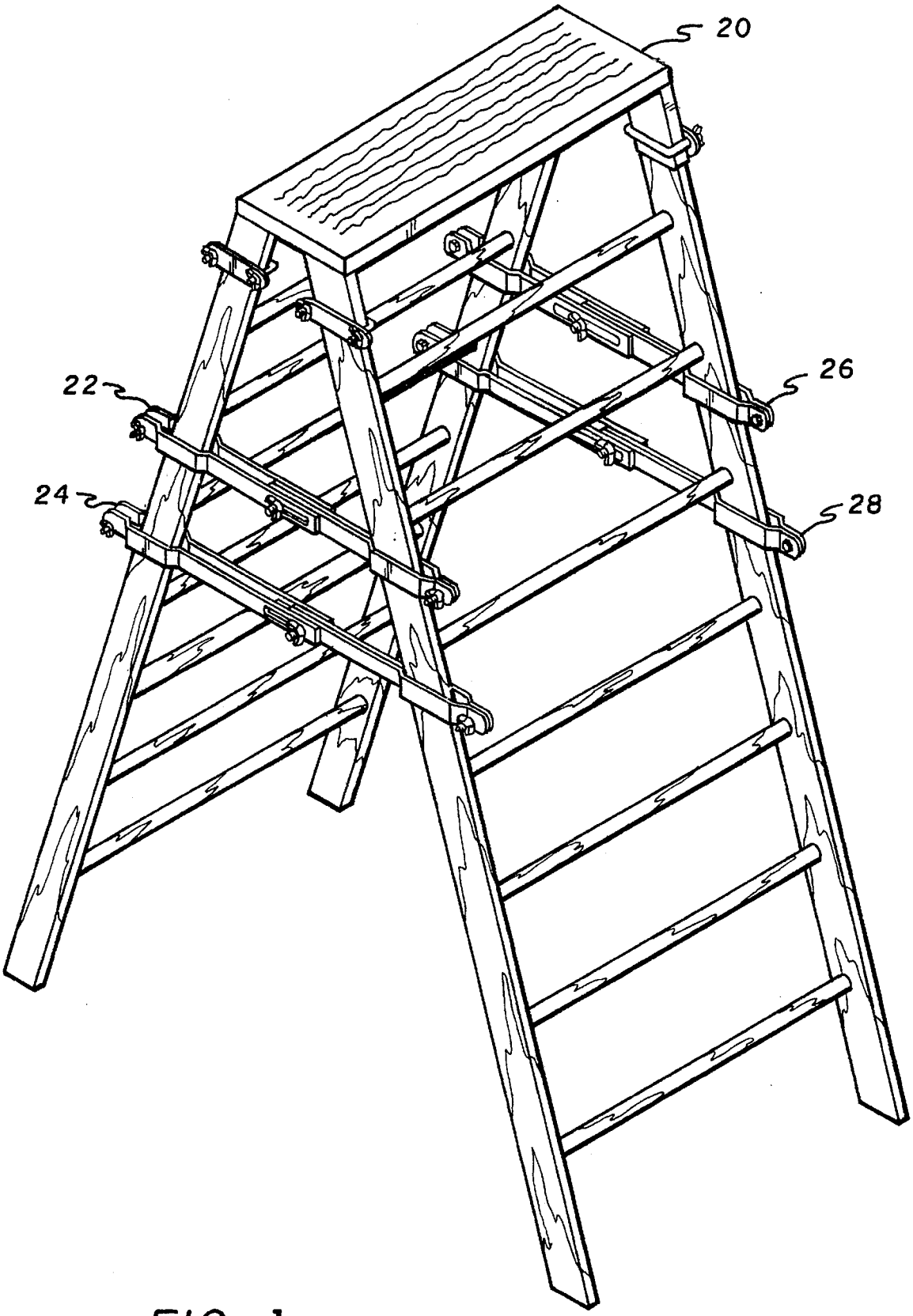
FIG. 1 is a perspective view of a preferred embodiment of the invention, installed on the two sections of an extension ladder, thereby converting the ladder to a stepladder.
Figure 2:
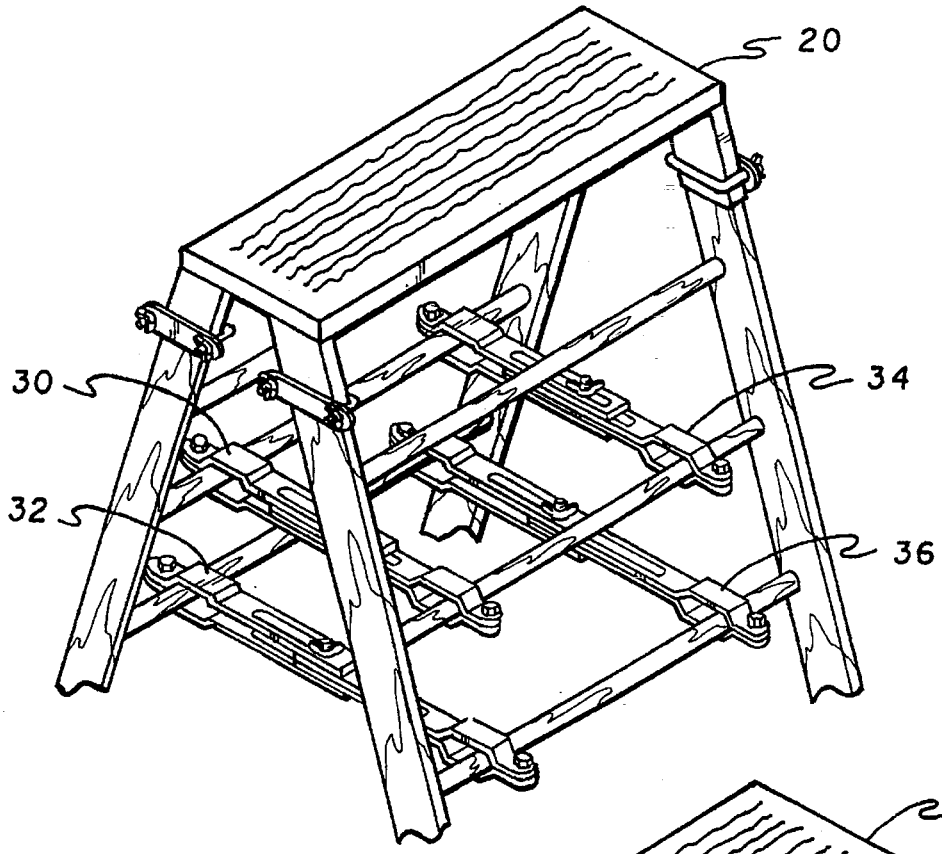
FIG. 2 is a partial perspective view of the preferred embodiment of the invention, showing the support braces clamped onto rungs of the converted ladder.
Figure 3:
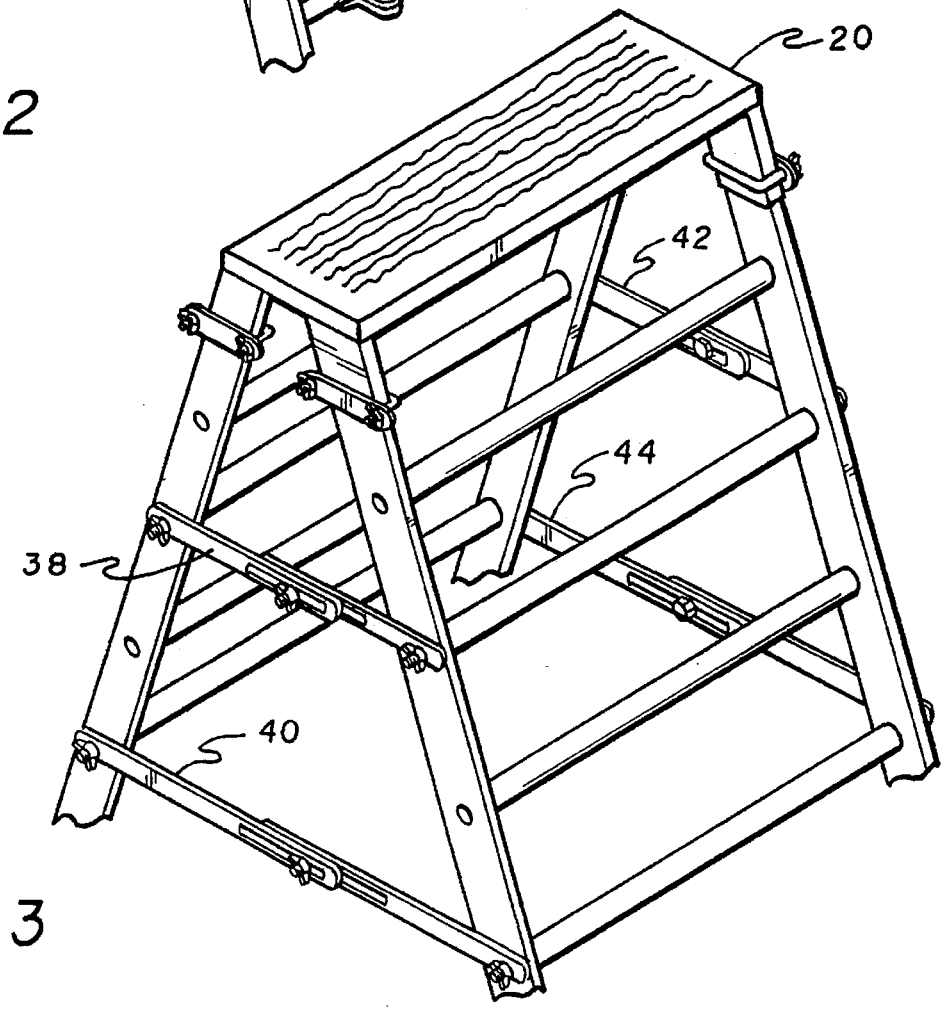
FIG. 3 is a partial perspective view of the preferred embodiment of the invention, showing the support braces fastened to rods passing through rungs of the converted ladder.

FIG. 1 shows a first embodiment, in which the two ladder elements are joined by a pedestal 20 that is clamped to each of the side rails of the extension ladder sections. Four support braces 22, 24, 26 and 28 are clamped around the side rails to hold the ladder elements together in a fixed, step-ladder disposition. Alternatively, as seen in FIG. 2, the support braces 30, 32, 34 and 36, are clamped around the rungs of the ladder elements. Braces 30, 32, 34, 36 can be identical to the braces 22, 24, 26, 28, or may have slightly narrower clamping ends for fitting around ladder rungs instead of side rails. In FIG. 3, support braces 38, 40, 42 and 44 are provided and are attached to rods inserted through rungs of the ladder sections; details of this construction are set forth below.

Figure 4:
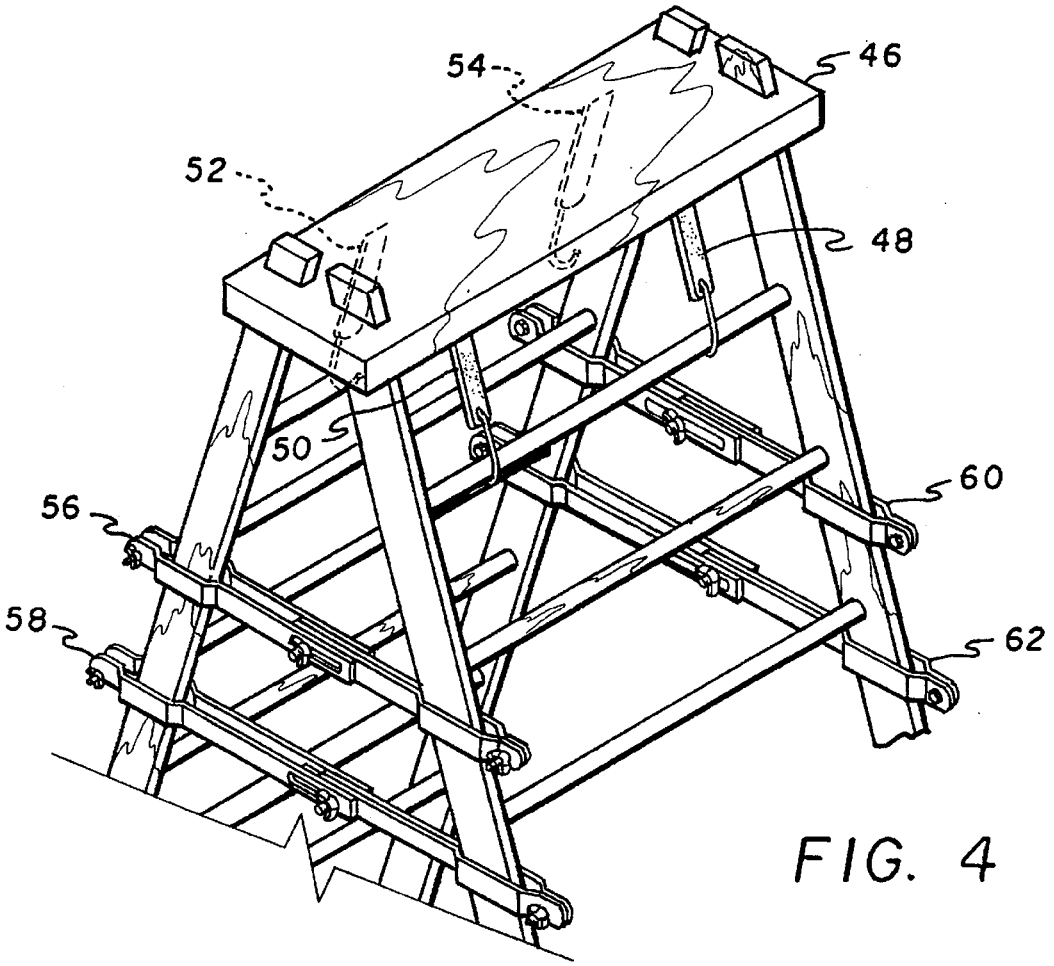
FIG. 4 is a partial perspective view of another embodiment of the invention.

FIG. 4 shows a second embodiment of the invention, in which the pedestal 46 has slots to receive the tops of the side rails of the ladder sections in interfitted relationship. Pedestal 46 is also held in place by bungee cords 48, 50, 52 and 54 that are hooked onto the top rungs of the ladder elements. Four support braces 56, 58, 60 and 62 are clamped around that side rails of the ladder sections; these are identical to the braces 22, 24, 26 and 28.

Figure 5:
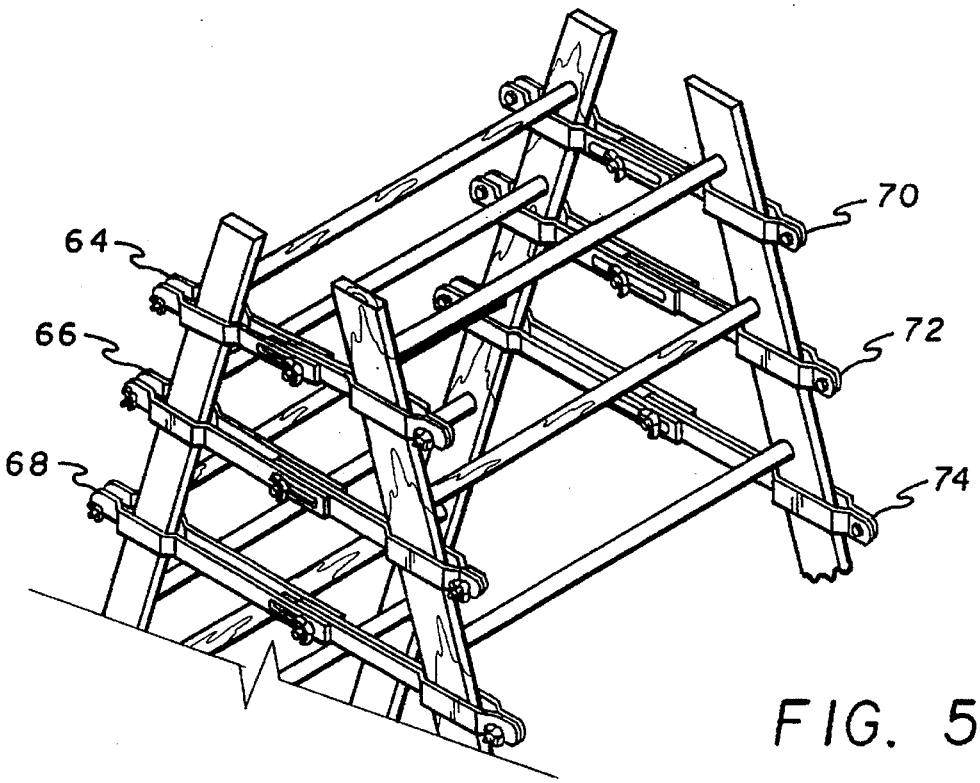
FIG. 5 is a partial perspective view of a further embodiment of the invention.

FIG. 5 discloses a third embodiment, in which there is no pedestal. The ladder elements are joined only by support braces 64, 66, 68, 70, 72 and 74, which are clamped around the side rails. For both of the second and third embodiments, the support braces could also be clamped around the rungs, or attached to rods inserted through the rungs.

Figure 6:
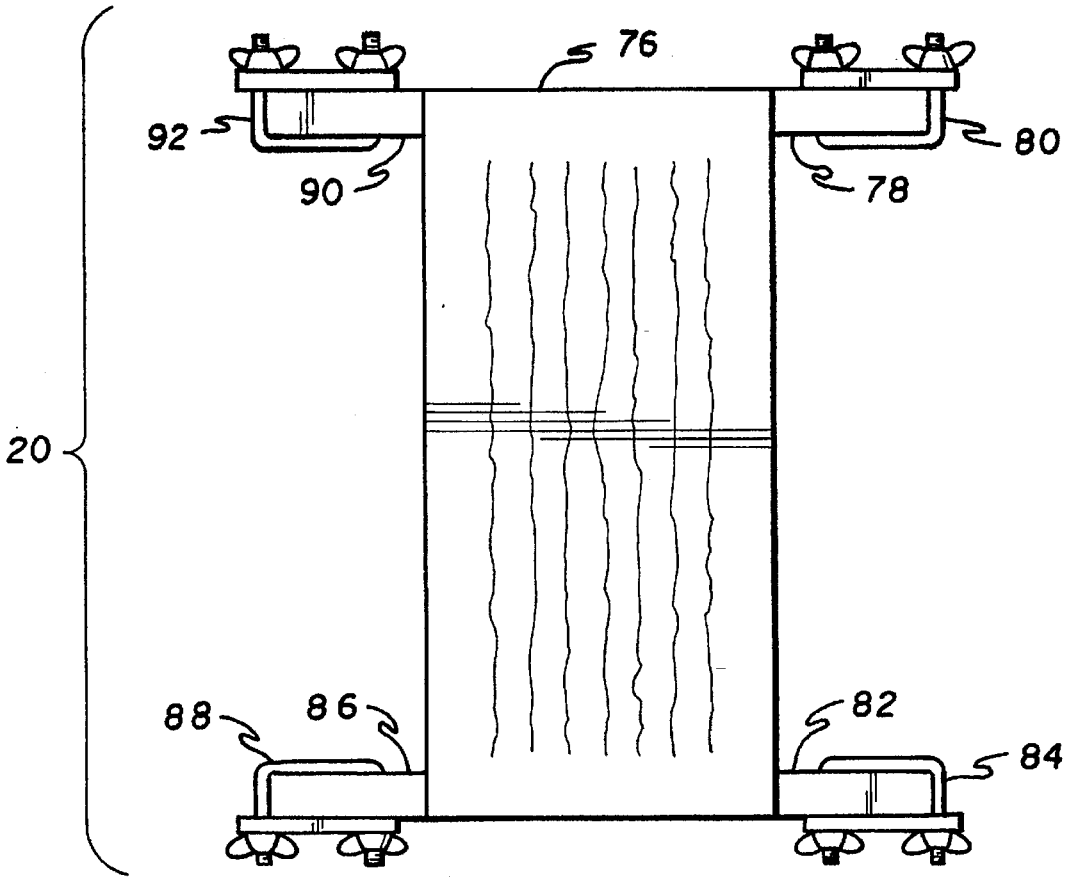
FIG. 6 is a top view of the top pedestal in the preferred embodiment of the invention, drawn to an enlarged scale.
Figure 7:
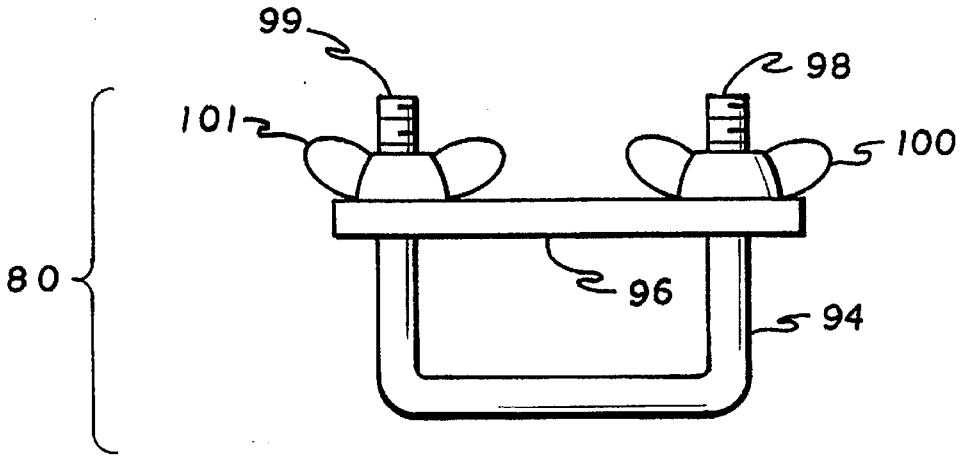
FIG. 7 is an enlarged scale, elevational side view of one of the clamps by which the pedestal is fastened to the tops of the side rails of the extension ladder sections.

FIG. 6 discloses the pedestal 20 for the first embodiment. It includes a flat supporting surface 76 with tread grooves to provide friction to prevent a person or object from slipping off the pedestal top surface. Sleeve legs 78, 82, 86 and 90, extend from the supporting surface to fit over the tops of the side rails of the ladder sections, and clamps 80, 84, 88 and 92 are attached to the legs to fasten the side rails to the pedestal 20. FIG. 7 is an enlarged view of one of the clamps 80, showing a U-bolt 94 that fits around three sides of a side rail, and a compression plate 96 that holds onto the other side of the side rail. There are threaded portions 98 and 99 at each end of the U-bolt, onto which wing nuts 100 and 101 are threaded to tighten the clamp in place. Clamps 84, 88 and 92 are identical to clamp 80.

Figure 8:
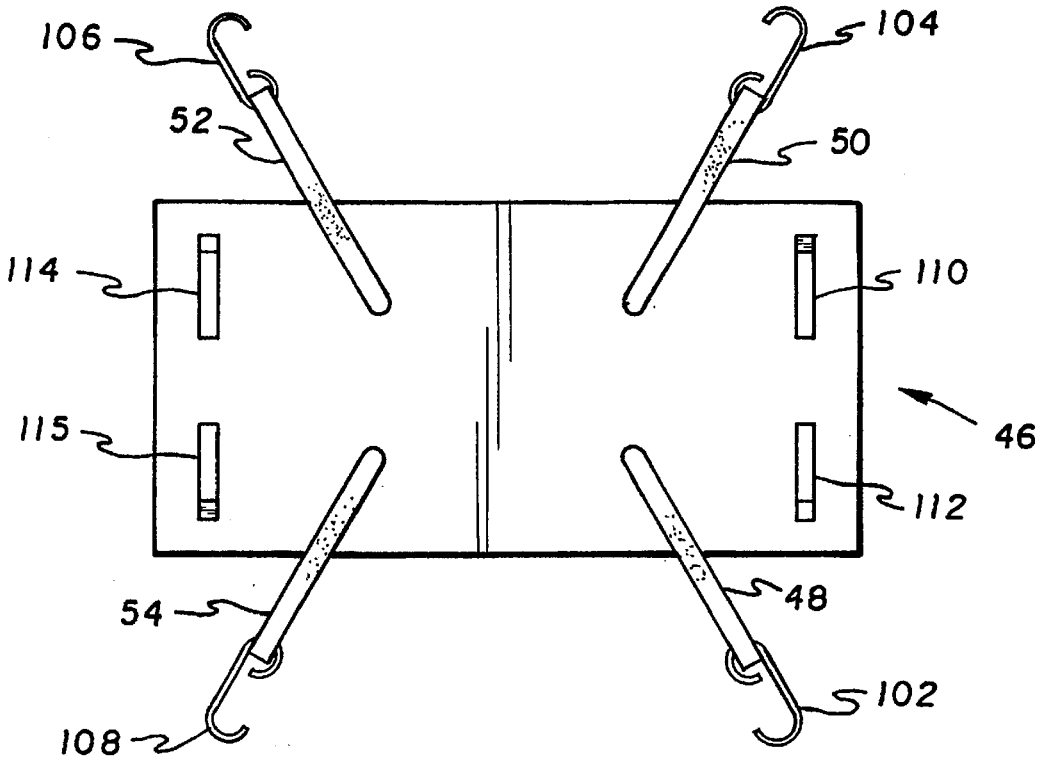
FIG. 8 is a bottom view of the pedestal of the second embodiment of the invention, and also showing attaching bungee cords.

Turning now to FIG. 8, the pedestal 46 of the second embodiment has four bungee cords 48, 50, 52 and 54 mounted into the bottom of the pedestal 46, at the ends of which are hooks 102, 106 and 108 which are attached to rungs of the ladder elements. There are four slots 110, 112, 114 and 116 through which the tops of the side rails of the extension ladder sections fit, so as to retain the pedestal 46 on the uppermost rungs of the ladder elements.

Figure 11:
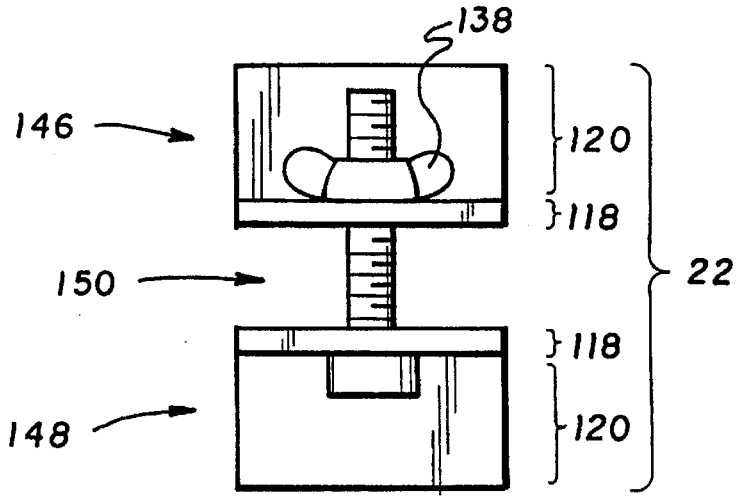
FIG. 11 is a rear view of the brace as seen in FIG. 9.
Figure 9:
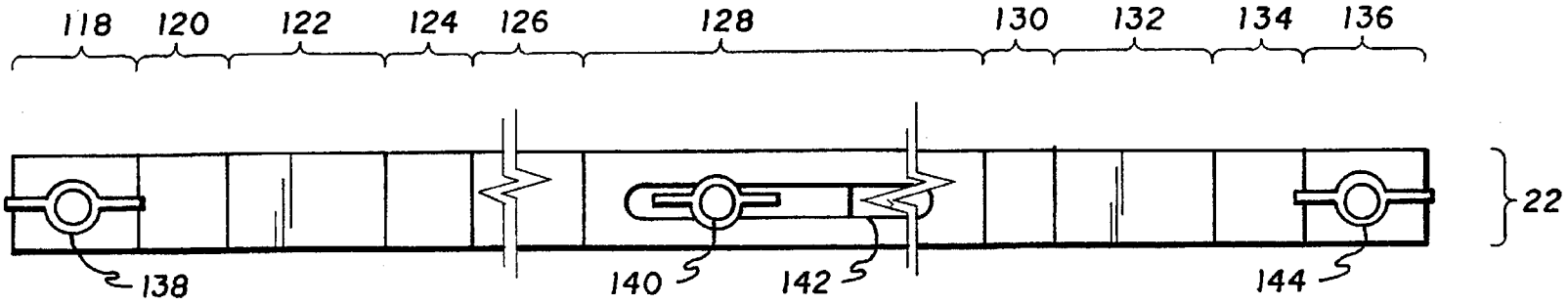
FIG. 9 is a partial, enlarged scale top view of one of the support braces seen in FIGS. 1 and 2.
Figure 10:
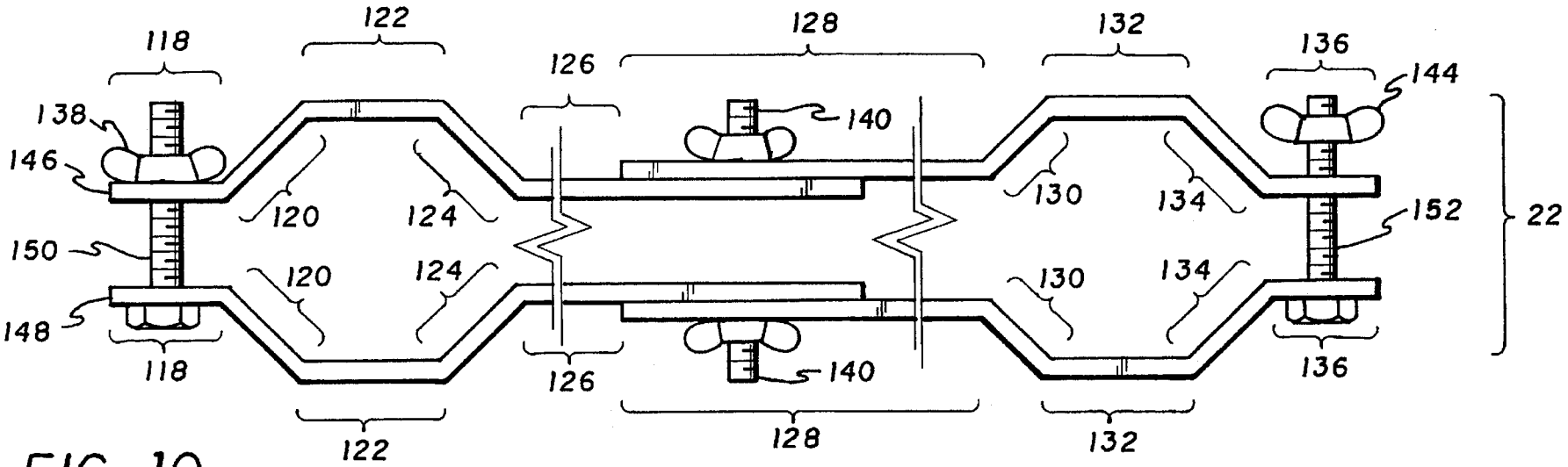
FIG. 10 is an elevational side view of the brace as seen in FIG. 9.

FIGS. 9–11 illustrate support braces that hold the ladder sections together either by the side rails or rungs. Each support brace has an upper member 146 and a lower member 148, which are joined by screws 150 and 152, on which are threaded wing nuts 138 and 144, which are turned to tighten or loosen the support brace. Each member of the support brace has flat end sections 118 and 136, through which the screws fit, diagonal sections 120, 124, 130 and 134, which with outward sections 122 and 132 form pockets that fit around side rails or rungs. A narrower middle section 126, and a broader middle section 128 that fits over the narrower middle section are provided so as to make it possible to adjust the length of the support brace by changing the position of the screw 140 in slot 142.

Figure 12:
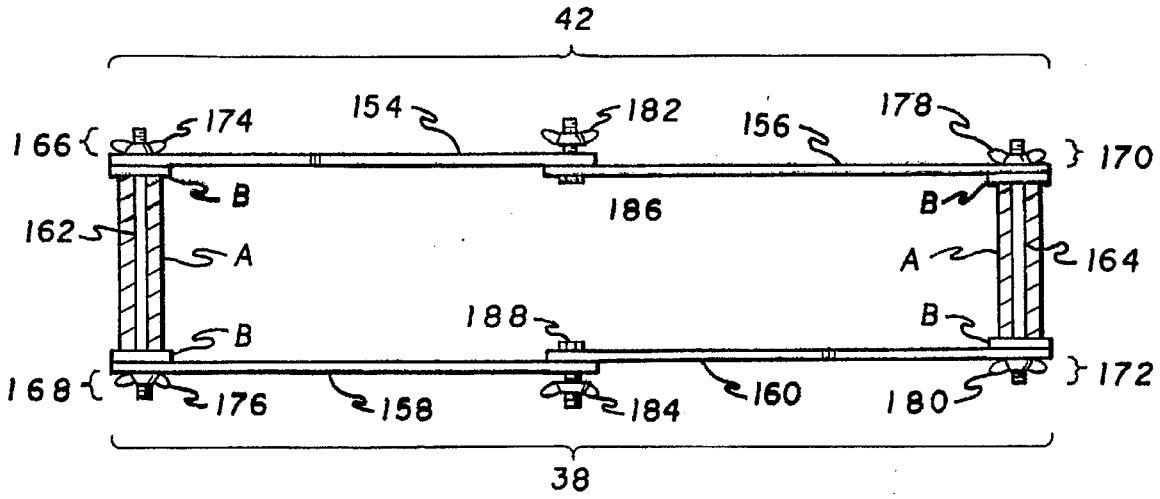
FIG. 12 is an enlarged scale, top plan view of a pair of the support braces and rods of FIG. 3, partly in section.
Figure 13:
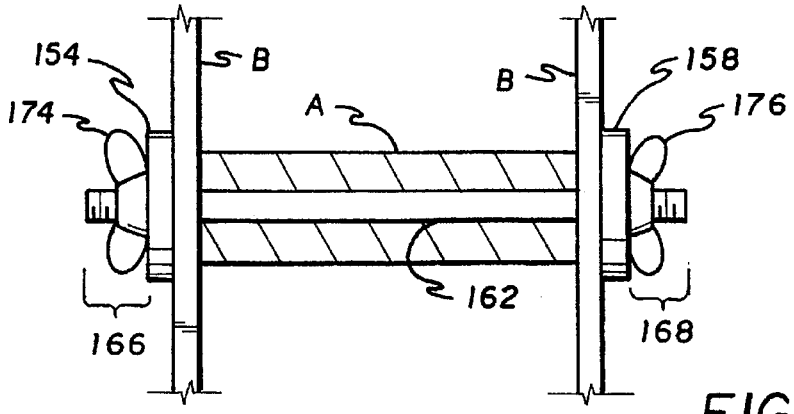
FIG. 13 is an enlarged scale detail view taken from FIG. 12.
Figure 14:
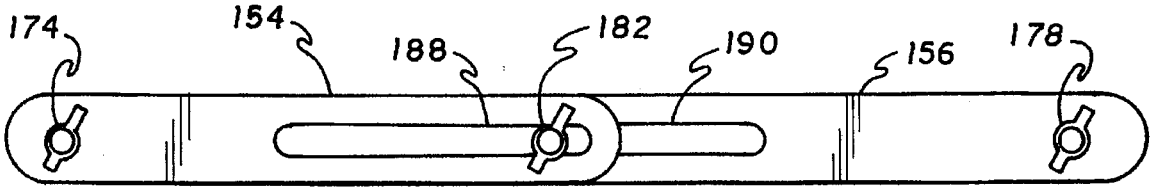
FIG. 14 is a front elevational view of a support brace as seen in FIG. 12, drawn to an enlarged scale.

FIGS. 12–14 show the support braces 38 and 42 attached to rods 162 and 164 which pass through rungs A, side rails B, and holes in the support braces. This variation is useful with metal (e.g., aluminum) ladders which have hollow rungs. The rods have threaded portions 166, 168, 170 and 172, on which wing nuts 170, 172, 174 and 176 are threaded to fasten the support braces to the rods. The support braces have outside sections 154 and 158, and inside sections 156 and 160, which are attached by screws 186 and 188, on which are threaded wing nuts 182 and 184. As shown in FIG. 14, each outside section of a support brace has a slot 188, and each inside section of a support brace has a slot 190. By loosening the screw in the slots, the length of the support brace can be adjusted, whereafter the screw is tightened to fix the adjusted position.

Figure 15:
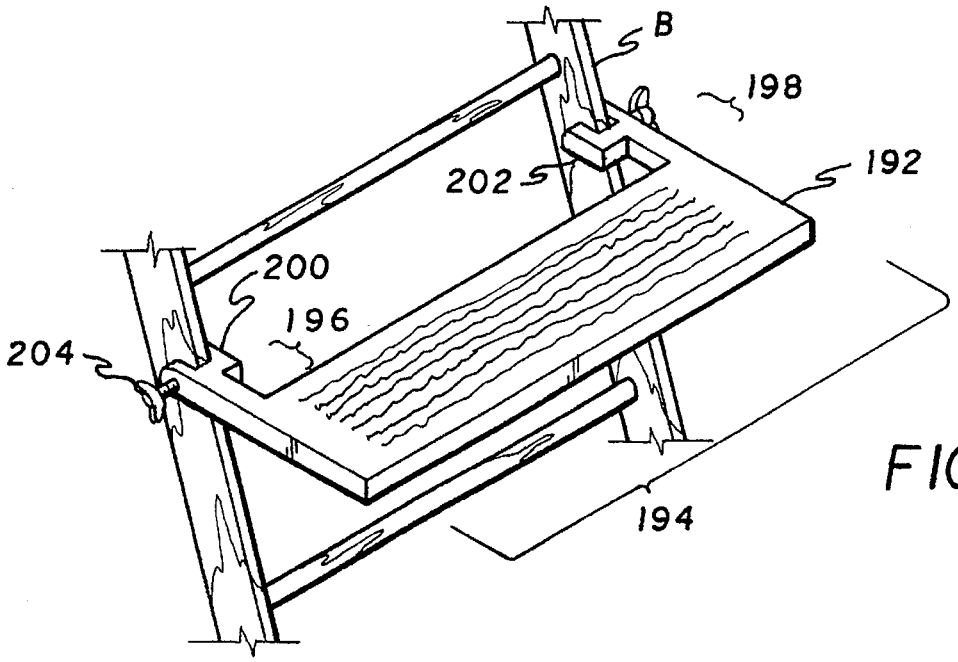
FIG. 15 is a perspective view of a paint tray of the kit.

Referring to FIG. 15, a paint tray 192 may be included witch each embodiment kit. The paint tray has a supporting surface 194 with tread groves to prevent a paint can or other object from slipping off the surface, and arms 196 and 198 attached to clamps 200 and 202 which are fastened to the side rails B. Each clamp is tightened by a wing nut 204.

Figure 17:
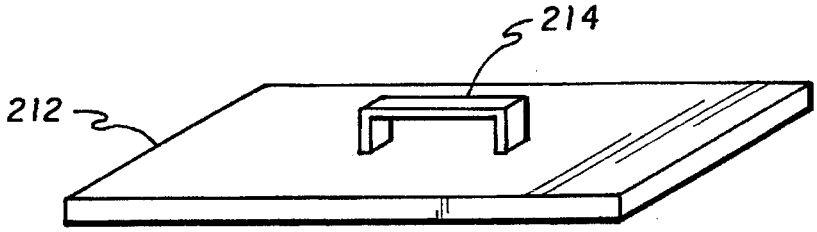
FIG. 17 is a perspective view of a lid for the storage container shown in FIG. 16.
Figure 16:
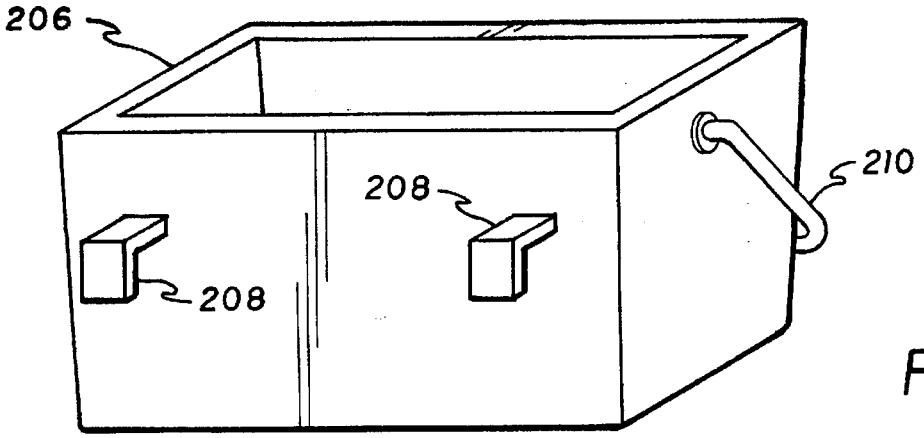
FIG. 16 is a perspective view of a storage container for the kit.

FIG. 16 shows the storage container 206 which holds the other elements of the ladder conversion kit. The storage container has hooks 208 by which it may be attached to the side of a ladder. Thus, the container may be employed to hold tools and other items for the convenience of the user while using the ladder to accomplish a task, and then later serve as a storage locker for the components of the conversion kit. A carrying handle 210 is also provided. FIG. 17 shows the lid 212 that fits over the storage container; the lid has a handle 214 by which the lid may be lifted to open the container.

It is to be understood that the present invention is not limited to the embodiments described above, but encompasses any and all embodiments within the scope of the following claims.

We claim:

1. A ladder conversion kit for converting an extension ladder into a stepladder, the ladder having first and second ladder sections of approximately equal length, each ladder section having two side rails connected by a plurality of rungs, said kit comprising:

a pedestal having a supporting surface and a plurality of hooked end elastic cords depending interiorly therefrom, said supporting surface having four slots configured and spaced so that the side rail upper ends of each ladder section fit through said slots, said supporting surface being retained on the upper ends of the rail of each ladder section, and said cords each having a first end attached to and beneath said supporting surface, and a second end terminating in a hook, the hooks being releasably attachable to rungs of the ladder sections, thereby further securing the supporting surface to the ladder sections; and at least one pair of support braces, each of said support braces being attachable to both the first and second ladder sections, to secure the ladder sections in a fixed, stepladder disposition.

2. The kit according to claim 1, in which there are at least two pairs of support braces, each of said pairs having different lengths, so as to be attached to said ladder sections at different locations.

3. The kit according to claim 1, said support braces further comprising means for adjusting the length of the said braces.

4. The kit according to claim 1, each of said support braces having a middle portion and first and second clamping end portions, each of said clamping end portions being dimensioned to enclose and clasp one of the rails and rungs of an associated ladder section, and means for securing said clamping portions in assembly with said ladder sections.

5. The kit according to claim 1, the ladder sections having hollow rungs, each of said pair of support braces having a middle portion and two end portions, and a pair of rods inserted through opposed rungs in the ladder sections, said braces being attached to said rods.

6. The kit according to claim 1, there further being releasable clamping means for tightly securing said pedestal support sleeves to the respective ladder sections.

7. The kit according to claim 1, further comprising a paint tray and a storage container for all the elements of the kit.

* * * * *